US011761638B2

(12) United States Patent
Chadwick et al.

(10) Patent No.: US 11,761,638 B2
(45) Date of Patent: Sep. 19, 2023

(54) HOME COOKING APPLIANCE HAVING AN AIR CHANNEL

(71) Applicant: BSH Home Appliances Corporation, Irvine, CA (US)

(72) Inventors: Temple Chadwick, New Bern, NC (US); David Dysinger, New Bern, NC (US); Tiffany E. Ingersoll, New Bern, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/681,878

(22) Filed: Feb. 28, 2022

(65) Prior Publication Data

US 2022/0268446 A1 Aug. 25, 2022

Related U.S. Application Data

(60) Division of application No. 16/357,680, filed on Mar. 19, 2019, now Pat. No. 11,313,564, which is a continuation of application No. 14/205,597, filed on Mar. 12, 2014, now Pat. No. 10,408,467, and a continuation of application No. 14/205,593, filed on Mar. 12, 2014, now Pat. No. 10,317,091.

(51) Int. Cl.
*F24C 15/00* (2006.01)
*F24C 15/02* (2006.01)

(52) U.S. Cl.
CPC ..... *F24C 15/006* (2013.01); *F24C 15/02* (2013.01)

(58) Field of Classification Search
None
See application file for complete search history.

(56) References Cited

U.S. PATENT DOCUMENTS

| | | | |
|---|---|---|---|
| 2,220,414 | A | 11/1940 | Kritzer |
| 2,526,890 | A | 10/1950 | Mendel |
| 3,659,579 | A | 5/1972 | Henderson et al. |
| 3,832,988 | A | 9/1974 | Doner |
| 4,430,541 | A | 2/1984 | Day, Jr. |
| 6,172,338 | B1 | 1/2001 | Barnes et al. |
| 6,761,159 | B1 | 7/2004 | Barnes et al. |
| 7,923,663 | B2 | 4/2011 | Kim et al. |

(Continued)

FOREIGN PATENT DOCUMENTS

| | | | |
|---|---|---|---|
| DE | 29602780 | U1 | 6/1997 |
| GB | 2208345 | A | 3/1989 |

(Continued)

OTHER PUBLICATIONS

Rabeeul I. Zuberi, National Search Reports, co-pending U.S. Appl. No. 14/205,593 dated Jun. 17, 2016, Dec. 1, 2016, May 19, 2017 and Oct. 19, 2017.

(Continued)

*Primary Examiner* — Jason Lau
(74) *Attorney, Agent, or Firm* — Michael E. Tschupp; Andre Pallapies; Brandon G. Braun

(57) ABSTRACT

A home cooking appliance includes a housing, a cooking compartment in the housing and accessible through a door in the housing, a cooling air system conveying air through the housing, and an air channel in fluid communication with the cooling air system, the air channel having an outlet exhausting a portion of the air from the cooling air system along a rear wall of the housing.

14 Claims, 15 Drawing Sheets

(56) References Cited

U.S. PATENT DOCUMENTS

| | | | |
|---|---|---|---|
| 2003/0037780 | A1 | 2/2003 | Wiersma et al. |
| 2006/0068694 | A1 | 3/2006 | Tajiri |
| 2013/0125764 | A1 | 5/2013 | Jeong et al. |

FOREIGN PATENT DOCUMENTS

| | | | |
|---|---|---|---|
| JP | 2006081745 | A | 3/2006 |
| JP | 2009216305 | A | 9/2009 |

OTHER PUBLICATIONS

Milan Makuch, European Search Report EP 15 15 7785 dated Jul. 16, 2015.

200

HOME COOKING APPLIANCE HAVING AN AIR CHANNEL

CROSS-REFERENCES TO RELATED APPLICATIONS

This application is a Divisional of U.S. application Ser. No. 16/357,680, filed Mar. 19, 2019, now U.S. Pat. No. 11,313,564, issued on Apr. 26, 2022, which is a Continuation of U.S. application Ser. No. 14/205,593, filed Mar. 12, 2014, now U.S. Pat. No. 10,317,091, which is related to Applicants' U.S. application Ser. No. 14/205,587, filed Mar. 12, 2014, now U.S. Pat. No. 10,288,298, entitled "HOME COOKING APPLIANCE HAVING A LOW-PROFILE REAR VENT TRIM"; and U.S. application Ser. No. 16/357,680 is a Continuation of U.S. application Ser. No. 14/205,597, filed Mar. 12, 2014, now U.S. Pat. No. 10,408,467, entitled "HOME COOKING APPLIANCE HAVING A FLUE BOUNDARY," the entire contents of which are incorporated herein by reference in their entirety.

FIELD OF THE INVENTION

The present invention is directed to a home cooking appliance having an air channel, and more particularly, to a home cooking appliance having an air channel that directs a portion of air exhausting the appliance along a rear wall of the appliance, and more particularly, to a home cooking appliance having an air channel in fluid communication with the cooling air system, the air channel having an outlet that exhausts a portion of the air from the cooling air system along a rear wall of the housing.

BACKGROUND OF THE INVENTION

A conventional home cooking appliance, such as a slide-in gas range, includes a housing having a cooking compartment, such as a baking oven, convection oven, steam oven, warming drawer, etc., and a cooking surface formed, for example, by cooking grates disposed over gas burners on top of the housing. A conventional slide-in range is installed in a cooking area of a home kitchen with a rear wall of the appliance facing a back wall of the kitchen. The appliance typically is disposed between counters with floor cabinets below the counters. The kitchen may include wall cabinets mounted on the back wall of the kitchen either over the cooking surface of the range or over the adjacent floor cabinets, and/or another appliance or component, such as an over-the-range (OTR) microwave oven or an OTR convection microwave oven over the cooking surface.

Industry standards and regulations commonly dictate acceptable temperatures of the combustible back wall behind the appliance, acceptable temperatures of cabinets or components over the range or adjacent to the range, as well as acceptable door temperatures for the appliance, during high temperature events, such as during a self-cleaning cycle of the oven while all burners on the cooktop are on a highest heat setting. The appliance must be able to exhaust cooling air and flue gases from the cooking compartment to maintain acceptable door temperatures for the appliance, acceptable surface temperatures for the appliance, acceptable temperatures of a combustible back wall behind the appliance, and acceptable temperatures of cabinets or components over the range or adjacent to the range.

Conventional appliances include various structures and techniques designed to manage and dissipate the hot air being exhausted from the appliance while complying with industry standards and regulations. In order to provide enough air flow through the appliance to maintain acceptable surface temperatures and oven door temperatures and to protect components in and around the appliance, many conventional appliances use costly designs and door construction that increases the air flow through the door and the housing, and/or include raised vent trims on top of the appliance with greater air flow and louder fans. Additionally, conventional home cooking appliances may require a rear wall of the appliance to be spaced from the combustible back wall by a certain amount of clearance in order to manage and dissipate hot air from the appliance in order to improve compliance with the industry standards and regulations.

SUMMARY OF THE INVENTION

The present invention, as illustrated for example in the exemplary embodiments, is directed to a home cooking appliance comprising a housing, a cooking compartment in the housing and accessible through a door in the housing, a cooling air system conveying air through the housing, and an air channel in fluid communication with the cooling air system, the air channel having an outlet that exhausts a portion of the air from the cooling air system along a rear wall of the housing.

In this way, the present invention provides a home cooking appliance having an air channel that increases air flow through the appliance while reducing or balancing pressure in the cooling air system and reducing or minimizing cooling fan noise.

Other features and advantages of the present invention will be described below. To provide a better understanding of the invention, and for further clarification and background of the present invention, various aspects and considerations of a home cooking appliance, which have been recognized by the present invention, first will be explained in greater detail.

As explained above, in order to provide enough air flow through the appliance to maintain acceptable surface temperatures and oven door temperatures and to protect components in and around the appliance, many conventional appliances use costly designs and door construction that increases the air flow through the door and the housing with greater air flow and louder fans. Conventional appliances also use larger, raised vent trims on top of the appliance with greater air flow and louder fans. However, these conventional designs can require expensive redesigns of the oven door, cooling air system, and exhaust vent, along with more powerful and louder fans for moving the cooling air, thereby resulting in increased manufacturing costs and an increase in fan noise for the user. These designs also can take up valuable space inside the oven door and/or the housing of the appliance, as well as valuable space on the top of the appliance, thereby restricting a size, for example, of the cooking compartment and/or cooking surface on top of the appliance. Additionally, these conventional designs can result in an increase in the air flow being exhausted over the appliance, and thus over the burners, which can disrupt the performance of the burners on the cooktop, and also can result in an increase in fan noise for the user. These conventional designs also can result in an increase in the air flow being exhausted toward the user, which is a common complaint of users.

In contrast to the conventional designs, the present invention provides an air channel that increases air flow through the appliance while reducing pressure in the cooling air system/system and reducing or minimizing cooling fan noise.

Particularly, the present invention provides an air channel, which is in fluid communication with the cooling air system, having an outlet (e.g., on a rear wall of the appliance) that exhausts a portion of the air from the cooling air system along the rear wall of the appliance. The present invention separates the air flow of the cooling air system between the rear vent trim and the air channel such that a portion of the airflow is exhausted from the rear vent trim and a remaining portion of the air flow is exhausted from the housing along the rear wall of the housing. In an exemplary embodiment, the cooling air system exhausts a portion of the cooling air through the air channel and into a space behind the appliance, while the remainder of the cooling air is exhausted through the rear vent trim as usual. For example, the cooling air system can exhaust greater than 50% of the air through the air channel and behind the appliance. In another embodiment, the cooling air system can exhaust less than 50% of the air through the air channel and behind the appliance. In yet another embodiment, the cooling air system can exhaust the same amount of air (e.g., 50%) from the air channel as the rear vent trim.

In this way, the present invention provides a plurality of hot air extraction points on different locations of the appliance, rather than relying on a single hot air extraction point. By dividing or separating the air flow from the cooling air system between the rear vent trim (on top of the appliance) and the air channel (on the rear wall of the appliance), the present invention is capable of increasing air flow without increasing fan noise to the user. For example, the full capacity of a fan can be utilized, or a more powerful fan can be used, without increasing fan noise to the user.

The air channel operates as a decompression chamber to depressurize the airflow in the cooling air system and directs a portion of the airflow out of the rear wall of the appliance into a space between the rear wall of the appliance and the back wall of the kitchen. In an exemplary embodiment, the air channel directs a portion of the airflow along the rear wall of the appliance; for example, in a downward direction along the rear wall of the appliance. In this way, the exhausted air can be naturally dispersed around the appliance in the cabinet area.

Moreover, the balanced pressure within the air cooling system can improve air flow and avoid pressure build-up in areas of the system. The balanced air flow in and around the appliance also can improve combustion in the oven and/or at the gas burners.

The air channel can be formed by an opening or outlet, for example, in the rear wall of the appliance that exhausts a portion of the air from the cooling air system into the space behind the appliance, and need not be any particular shape, size, or arrangement. The air channel, or the outlet of the air channel, can be formed in other components or surfaces of the appliance that are capable of exhausting a portion of the air from the cooling air system into the space behind the appliance. In an embodiment, the outlet of the air channel is configured to direct the air downward (e.g., vertically or at an angle) from the outlet along an exterior surface of the rear wall of the housing, thereby improving dispersion of the hot air around the appliance in the cabinet area. In other embodiments, the outlet of the air channel can be configured to direct the air laterally along the rear wall of the appliance, or upward (e.g., vertically or at an angle) along the rear wall of the appliance, thereby improving dispersion of the hot air around the appliance in the cabinet area. In other embodiments, the outlet of the air channel can be configured to direct the air along the rear wall of the appliance in a plurality of directions (e.g., one or more of vertically downward, vertically upward, at a downward angle, at an upward angle, and/or laterally/horizontally).

The outlet of the air channel optionally can include, for example, a deflector, flange, or the like that directs or deflects the air from the outlet along an exterior surface of the rear wall of the housing. For example, the outlet of the air channel can include a deflector, flange, or the like that directs or deflects the air from the outlet vertically downward along an exterior surface of the rear wall of the housing. Alternatively, the outlet of the air channel can include a deflector, flange, or the like that directs or deflects the air from the outlet at a downward angle other than a vertical direction. In other embodiments, the outlet of the air channel can include a deflector, flange, or the like that directs or deflects the air from the outlet laterally or horizontally along the rear wall of the appliance, or upward (e.g., vertically upward or at an upward angle) along the rear wall of the appliance.

The air channel can be on an exterior surface of the rear wall of the housing. The air channel can be coupled to the rear wall or integrally formed with the rear wall. In other embodiments, the air channel can be disposed inside the housing with respect to the rear wall with the outlet of the air channel exiting the rear wall to the exterior of the housing.

As explained above, the air channel can be formed by an opening in the rear wall of the appliance that exhausts a portion of the air from the cooling air system into the space behind the appliance, and need not extend along a surface of the appliance. In other embodiments, all or a portion of the air channel can extend along the rear wall of the housing, such as in a downward direction (e.g., vertically downward or at a downward angle), an upward direction (e.g., vertically upward or at an upward angle), or a lateral or horizontal direction. As explained above, the air channel or the outlet of the air channel can be formed in other components or surfaces of the appliance that are capable of exhausting a portion of the air from the cooling air system into the space behind the appliance.

The present invention recognizes that the hot air being exhausted into the area behind the appliance may not be evenly distributed. The present invention also recognizes that various components of the appliance may be affected to a larger extent by the hot air than other components. For example, if a temperature of a component, such as a relay board of the appliance, exceeds a threshold temperature, the component may be shut down as a safety measure until the component cools to within acceptable temperatures. According to the present invention, the cross sectional size, length, and/or angle of the air channel, the fan power and fan speed, and other features and functions of the air cooling system can be optimized for the particular cooking appliance to provide passing results on both self-clean testing and all cooktop testing.

For example, the air channel can be configured to optimize the placement of the hot air behind the appliance to more evenly distribute the heat and minimize or avoid an effect of the hot air on components of the appliance. The air channel can be configured to exhaust air in particular locations, or to avoid particular locations, to minimize exposure of certain areas or components to the hot air, thereby minimizing or avoiding a rise in temperature at these areas or components. The air channel also can be optimized to direct the hot air in a manner that increases temperatures in areas where low temperatures are normally present, and minimize or avoid directing the hot air to areas where higher temperatures are normally present. The air channel can be optimized to direct the hot air in a manner that more evenly distributes heat at other areas of the appliance, such as, in an area of the rear vent trim as the hot air behind the appliance rises upward along the rear wall and past the rear vent trim at the top of the appliance.

To do this, the air channel can be configured, for example, to extend along the rear wall of the appliance to exhaust the air in particular locations and/or in particular directions. The air channel can extend in any direction. For example, the air channel can extend vertically, horizontally, or at an angle. The air channel also can extend in multiple directions. The air channel can be one or more of straight, angled, and/or curved. The air channel can have a uniform cross-section along all or a part of the length, or the cross-section can vary along all or a part of the length. For example, the cross-section can vary in particular areas, or vary continuously along a particular length, etc. The air channel can include an outlet that directs the hot air in a particular direction. The outlet may direct the air in a different direction than the direction in which the air channel is angled on the rear wall. For example, in an exemplary embodiment, the air channel can be configured to extend from a central location in an upper region of the rear wall at an angle toward a lower corner of the rear wall. The outlet can then direct the air in a different direction than the direction in which the air channel is angled on the rear wall such that the hot air flows along the rear wall, for example, toward an opposite side of the rear wall. In this way, the air channel can be optimized to more evenly distribute the hot air in the area behind the appliance.

Various arrangements of the air channel are possible. The air channel can include an inlet and an outlet, wherein the inlet is in fluid communication with the cooling air system and the outlet is open to an exterior of the rear wall of the appliance, and wherein the outlet is arranged closer to a bottom of the rear wall of the appliance than the inlet. The air channel can be formed by a stand-alone component, such as a sealed duct or channel, extending between the inlet and the outlet. In another embodiment, air channel can be formed by one or more walls cooperating with the rear wall of the appliance to form a flow path between the inlet and the outlet. For example, the air channel can include a rear wall that is arranged, for example, coplanar with the rear wall of the appliance, along with a pair of sidewalls extending from the rear wall of the air channel to the rear wall of the appliance, thereby defining an air flow path between the inlet and the outlet.

According to the present invention, the air channel can assist with reducing surface temperatures on the oven door and other surfaces of the appliance by increasing an air flow through the oven door and the appliance without requiring a costly and time consuming redesign or reconstruction of the oven door, without increasing a size of the rear vent trim on the top of the housing, and/or without increasing fan noise. Particularly, the present invention can increase an air flow through the oven door and the cooling air system without increasing the size of the rear vent trim and without increasing the air flow over the burners, thereby avoiding disruptions to the performance of the burners on the cooktop and allowing the burners to function effectively even at lowest settings (without nuisance clicking). The present invention can increase an air flow through the oven door and the cooling air system without increasing the size of the rear vent trim and without increasing the power of the fan and without increasing fan noise. As a result, the exemplary air channel enables the use of a low-profile rear vent trim on the top surface of the appliance that can maximize a size of the cooking surface on the cooktop and provide a "built-in" appearance, which is desirable to users.

The present invention also can minimize or avoid blowing air in a direction of the user by exhausting the hot air into the area behind the appliance.

As explained above, conventional home cooking appliances may require a rear wall of the appliance to be spaced from the combustible back wall by a certain amount of clearance in order to manage and dissipate hot air from the appliance and to maintain a safe distance between hot surfaces of the appliance and combustible walls or components, in order to comply with the industry standards and regulations. The air channel according to the present invention provides a unique way of managing heat and combustion in which hot air exhausting from a cooling air system can be distributed in multiple locations and more evenly around the appliance, thereby resulting is minimal radiant heat transfer that allows the appliance to be installed against the back wall with minimal clearance (e.g., a 3 mm space), or no clearance at all.

Moreover, the present invention recognizes that a combination of factors, such as the rear vents being located at the rear of the cooking appliance away from the user, a low pressure at a surface of the back wall of the kitchen located behind the appliance, convective heat transfer from flue gases and cooling air to the back wall of the kitchen, and the heated air exiting the rear vents in a vertical direction, can result in an increase in temperatures at areas of the back wall of the kitchen located behind the appliance, as well as at areas of other components that are adjacent to the appliance, such as wall-mounted kitchen cabinetry, other appliances such as an over-the-range (OTR) microwave. During operation of the appliance, cool air naturally flows in from the front of the range (from the kitchen). The hot air from the burners and oven naturally collects at the back wall, and particularly at a center of the back wall above the range, for example, due to factors such as, for example, a low pressure at a surface of the back wall and convective heat transfer from flue gases to the back wall of the kitchen. The present invention recognizes that if the air-flow is not controlled or optimized, this hot air may increase temperatures, and in some cases, result in damage to the combustible surfaces of the back wall or other components, such as an OTR microwave. The present invention also recognizes that, while cook top burners are in operation, it is desirable for the rear vent trim to direct the cook top heat away from the back wall without negatively affecting low simmer rates. Thus, the air-flow preferably is managed and optimized in a way that reduces wall temperatures and component temperatures while also maintaining passing combustion results at the gas burners and in the cooking compartment, and while at the same time minimizing noise to the user.

In addition to the air channel, an embodiment of the present invention includes a rear vent trim that assists with controlling and managing the air flow by directing the flow of flue gas and/or cooling air from the rear vent trim forward and away from a combustible back wall of the kitchen while simultaneously reducing turbulence above the cooking surface, thereby minimizing temperatures on the combustible back wall of the kitchen and improving compliance with industry standards and regulations, while also maintaining passing combustion results at the gas burners and the cooking compartment, minimizing noise to the user, and providing a low profile, rear vent trim that is substantially flush with cooking grates of the home cooking appliance. This embodiment deviates from conventional designs, which increase a height of the vent above the cooking surface, and instead provides a low-profile rear vent trim that is substantially flush with the cooking surface, which provides a "built-in" appearance that it desirable by many users. Additionally, this embodiment deviates from conventional designs, which exhaust flue gases and cooling air upward from the housing in a vertical direction (i.e., at a 90° angle with respect to the surface of the cooktop or cooking grates), and instead provides a low-profile, substantially flush, rear vent trim that directs air away from a 90° angle with respect to the surface of the cooktop or cooking grates to direct the air flow from the rear vent trim forward and away from a combustible back wall of the kitchen, while simultaneously reducing turbulence above the cooking surface, and without increasing an air flow through the appliance or from the cooking compartment or increasing fan noise for the user.

The exemplary embodiments of a rear vent trim can include one or more openings for permitting air to exit from within the rear vent trim while directing the flue gas and/or cooling air away from the back wall. In an exemplary embodiment, the rear vent trim is configured to separate the cooling air and flue gases and to exhaust the separate cooling air and flue gas from different openings in the rear vent trim while directing both the cooling air and flue gas away from the back wall. In another example, the separate cooling air and flue gases are directed away from the back wall and the different streams are directed beneath the cooking grates and above the grates, respectively. For example, the rear vent trim directs the separate cooling air away from the back wall and in a direction above the cooking grates, while the flue gases are directed away from the back wall and in a direction beneath the cooking grates. The structure for directing the flue gas can be formed by a flue boundary and concealed from view by the low-profile rear vent trim. Similarly, the structure for directing the cooling air can be formed by a cooling rough-in box and concealed from view from above the appliance by the low-profile rear vent trim. In other embodiments, the rear vent trim can include structure, such as a diverter, for directing the flue gas and/or the cooling air from the flue boundary and/or the cooling rough-in box, respectively. The diverter can be concealed from view from above the appliance by the low-profile rear vent trim.

In this way, the features of the present invention can manage and dissipate the hot air being exhausted from the appliance to minimize or prevent convective heat transfer from flue gases to the back wall of the kitchen. The home cooking appliance also can reduce temperatures on other components, such as wall cabinets mounted on the back wall of the kitchen either over the cooking surface of the home cooking appliance or over the adjacent floor cabinets, and/or on another appliance or component, such as an over-the-range (OTR) microwave oven or OTR convection microwave oven, thereby improving compliance with industry standards and regulations. Additionally, the home cooking appliance can manage and dissipate the hot air being exhausted from the appliance in a manner that contributes to a reduction in temperatures on surfaces or components of the home cooking appliance itself, such as temperatures on an oven door, thereby improving compliance with industry standards and regulations. The features of the present invention also can manage and dissipate the hot air being exhausted from the appliance without interfering with the operation of the gas burners, thereby improving combustion at the gas burners. Moreover, the features of the present invention can increase an air flow for heat removal and dissipation without increasing a fan speed, and thus, without increasing fan noise.

The features of the present invention can be provided separately, or in combination with each other or in combination with other features of a home cooking appliance for managing and dissipating the hot air being exhausted from the appliance, thereby further improving compliance with industry standards and regulations.

The features of the present invention are not limited to any particular type of cooking appliance or to a cooking appliance having any particular arrangement of features. For example, one of ordinary skill in the art will recognize that the features of the present invention are not limited to a slide-in gas cooking appliance, and can include, for example, a built-in cooking appliance such as a gas range or gas oven, an electric range or oven, or another cooking appliance that will benefit from distributing the hot air being exhausted from the appliance around the appliance, thereby minimizing temperatures on the combustible back wall of the kitchen or another component, and improving compliance with industry standards and regulations.

For purposes of this disclosure, the term "back wall" refers to a combustible wall of a kitchen that faces a rear wall of the appliance when the appliance is in an installed position.

For purposes of this disclosure, an upper surface of the rear vent trim is substantially flush with an upper surface of the cooking surface if the upper surface of the rear vent trim is approximately level with the upper surface of the cooking surface, or for example, if at least the front edge or rear edge of the upper surface of the rear vent trim is approximately level with the upper surface of the cooking surface, or for example, if at least a part of the upper surface of the rear vent trim is approximately level with the upper surface of the cooking surface. One of ordinary skill in the art will recognize that the upper surface of the rear vent trim, or any part thereof, does not need to be exactly the same height as the upper surface of the cooking surface for the upper surface of the rear vent trim to be substantially flush with the upper surface of the cooking surface.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
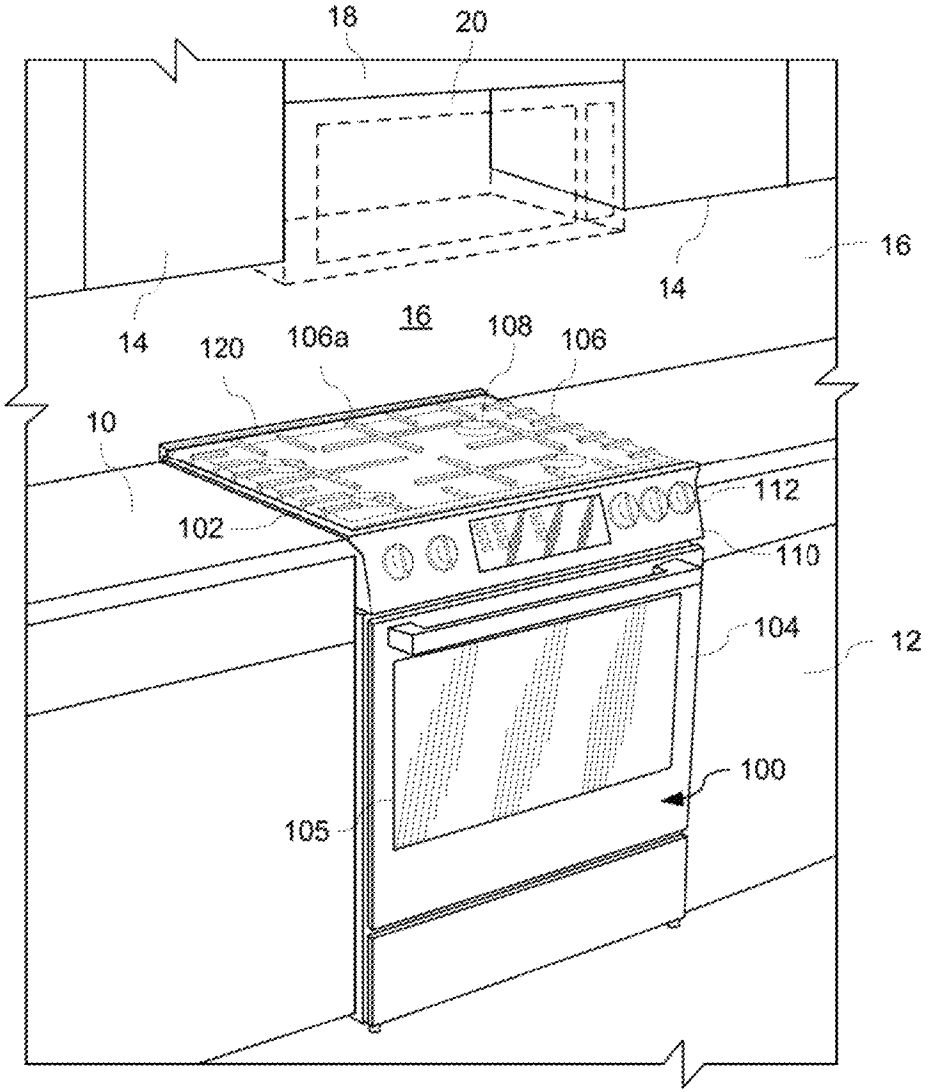
FIG. 1 is a perspective view of a home cooking appliance according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-11B illustrate exemplary embodiments of a home cooking appliance having a flue boundary and cooling rough-in box.

With reference to FIG. 1, a cooking area of a home kitchen may include counters 10 with floor cabinets 12 below the counters 10. The kitchen can include wall cabinets 14 on back wall 16 (e.g., a combustible back wall). A home cooking appliance 100, such as a slide-in home cooking appliance, can be disposed between the floor cabinets 12 and counters 10. A wall cabinet 18 or an over-the-range (OTR) microwave oven or convention microwave oven 20 can be disposed over the cooking surface 106 of the home cooking appliance 100.

With reference again to FIG. 1, an exemplary embodiment of a home cooking appliance 100 will now be described. The home cooking appliance 100 has a housing 102 with a cooking compartment, such as a baking oven, convection oven, steam oven, warming drawer, etc., in the housing 102 and accessible through a door 104 in a front of the housing 102. The door 104 has a door glass 105. The home cooking appliance 100 has a cooking surface 106 on a top of the housing 102. The cooking surface 106 can include one or more cooking grates having an upper surface 106*a* for supporting cookware over one or more gas burners 108. The appliance 100 includes a control panel 110 having a plurality of control knobs 112 for controlling the operation of the burners 108 and the cooking compartment. As shown in FIG. 1, the housing 102 can include a rear vent trim 120 on the top of the housing 102 and at a rear side of the cooking surface 106. In an exemplary embodiment, the rear vent trim 120 can include an upper surface that is substantially flush with the upper surface 106*a* of the rear end of the cooking surface 110, thereby maximizing the cooking area of the appliance and providing a low-profile appearance.

Figure 2:
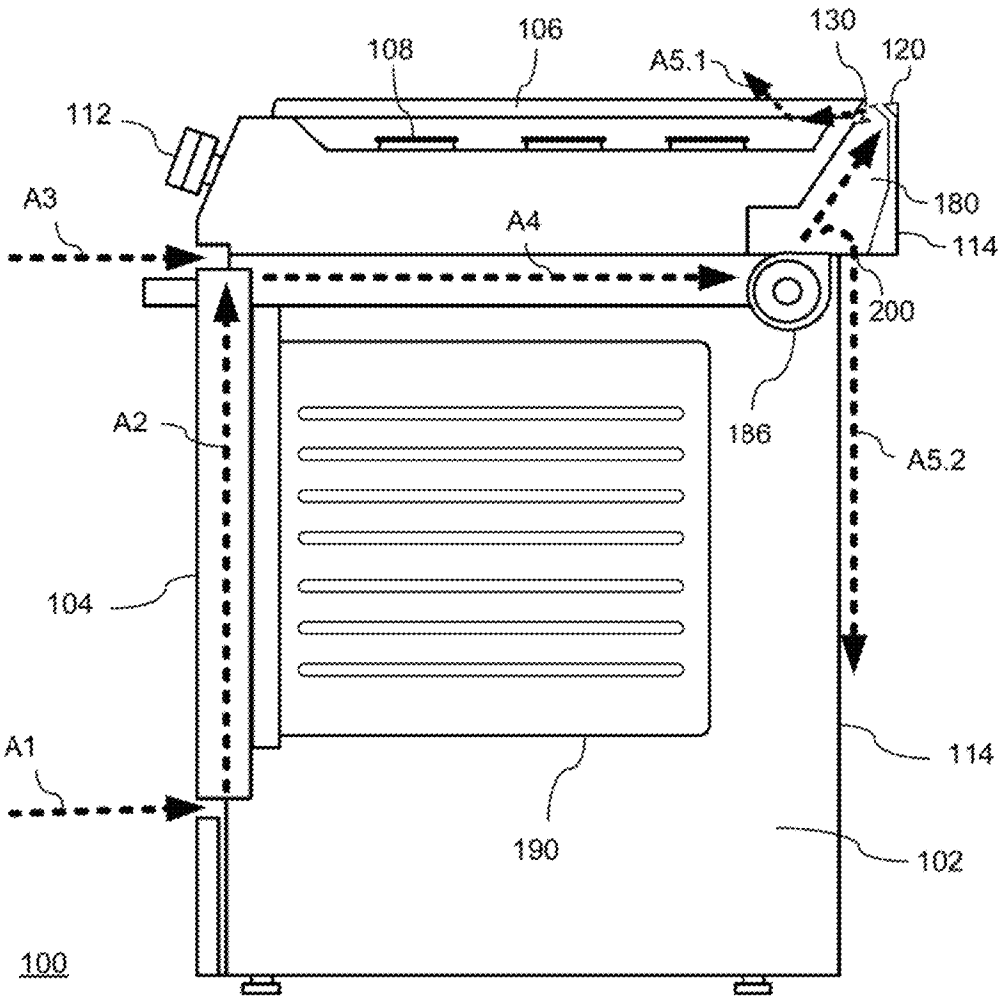
FIG. 2 is a schematic, cut-away view of a home cooking appliance according to an exemplary embodiment of the invention.
Figure 3:
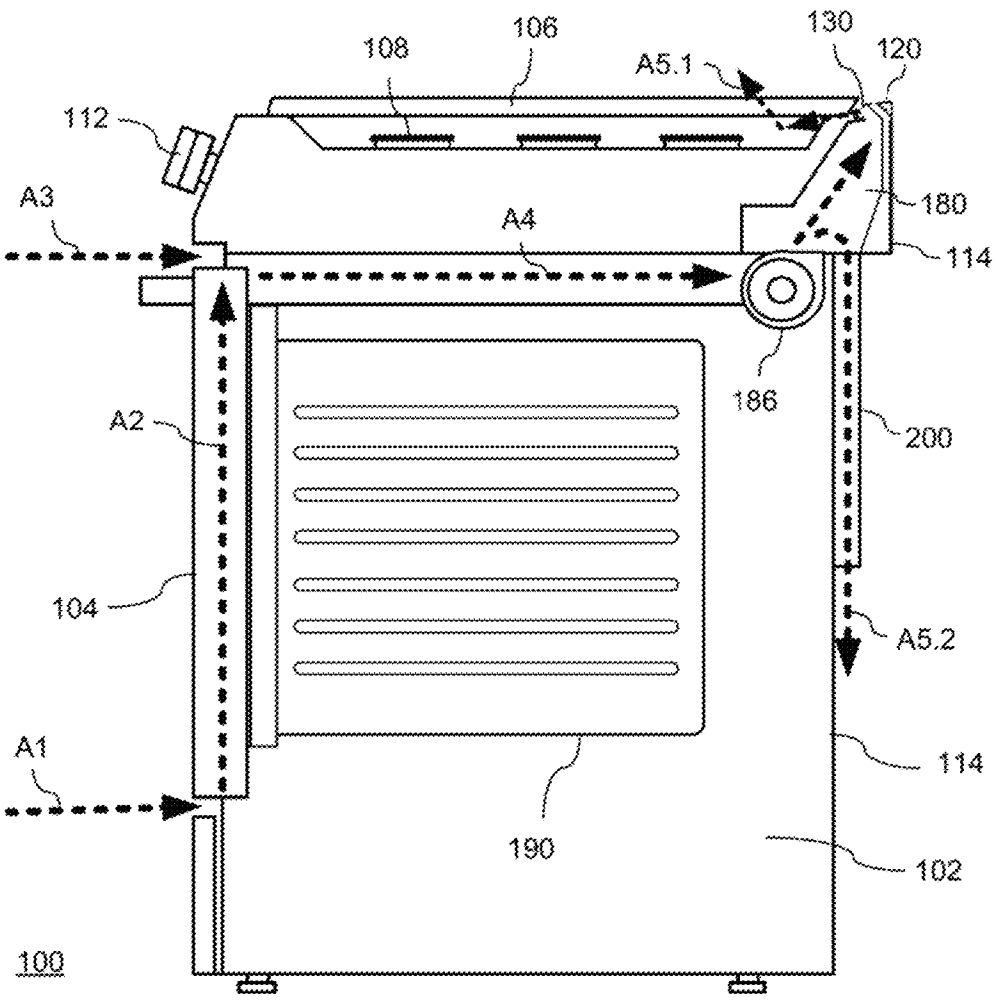
FIG. 3 is a schematic, cut-away view of a home cooking appliance according to another exemplary embodiment of the invention.

With reference to FIGS. 2 and 3, an exemplary embodiment of a home cooking appliance having an air channel will now be described.

As shown in FIGS. 2 and 3, a rear vent trim 120 is arranged at a rear side of the top of the appliance 100. The rear vent trim 120 includes a plurality of openings for exhausting air from within the housing. For example, one or more openings 130 are arranged in fluid communication with a cavity or duct 180 of a cooling air system through which cool ambient kitchen air is drawn in via one or more entry openings. More particularly, a fan 186 draws cool ambient kitchen air A1, A2 into the housing 102 and/or door 104 of the appliance 100. The air flows through the door 104 along flow path A2 and through the housing 102 along flow path A4 such that heat is transferred to the air for cooling the components of the appliance 100. The fan 186 draws the air through the appliance and then pushes the heated air A5.1 through the cavity 180, and out of the rear vent trim 120 via the opening 130. The air A5.1 is angled away from a 90° angle with respect to the upper surface 106*a* of the cooking surface 106 and through the opening 130 in the rear vent trim 120 in a direction, for example, under the cooking grate 106 and at an angle away from the burners 108 such that the air A5.1 does not disrupt the burner flame even when a burner 108 is on a lowest setting, and gently wisps out onto the cooktop spill tray on the top of the housing 102, where the air A5.1 rises and mixes with other air zones around the cooktop to control a heat plume over the cooktop and minimize temperatures of the back wall of the kitchen or other cabinets and components.

With reference again to FIGS. 2 and 3, the housing 102 includes an air channel 200, which is in fluid communication with the cooling air system, having an outlet (e.g., on the rear wall 114 of the housing 102) for exhausting a portion A5.2 of the air from the cooling air system. As shown in FIGS. 2 and 3, the air (A5.1, A5.2) exhausting of the cooling air system is separated between the rear vent trim 120 and the air channel 200 such that a portion A5.1 of the airflow is exhausted from one exit of the cavity 180 to the rear vent trim 120 and a remaining portion A5.2 of the air flow is exhausted from another exit of the cavity 180 to the air channel 200 where it is exhausted from the housing 102 along the rear wall 114 of the housing 102 by the air channel 200. In an exemplary embodiment, the cooling air system exhausts a portion A5.2 of the cooling air through the air channel and into a space behind the appliance 100, while the remainder of the cooling air A5.1 is exhausted through the rear vent trim 120.

The cooling air system can exhaust greater than 50% of the air through the air channel 200 and behind the appliance 100. In another embodiment, the cooling air system can exhaust less than 50% of the air through the air channel 200 and behind the appliance. In yet another embodiment, the cooling air system can exhaust the same amount of air (e.g., 50%) from the air channel 200 as the rear vent trim 120.

As shown in FIGS. 2 and 3, the appliance 100 provides a plurality of hot air extraction points on different locations 120, 200 of the appliance by dividing or separating the air flow from the cooling air system between the rear vent trim 120 (on top of the appliance) and the air channel 200 (on the rear wall of the appliance). The air channel 200 operates as a decompression chamber to depressurize the airflow in the cooling air system and directs a portion A5.2 of the airflow out of the rear wall 200 of the appliance 100 into a space between the rear wall 114 of the appliance and the back wall of the kitchen (not shown). In the example shown in FIGS. 2 and 3, the air channel directs a portion of the airflow along the rear wall of the appliance, and particularly, in a downward direction along the rear wall 114 of the appliance 100, which the exhausted air can be naturally dispersed around the appliance in the cabinet area. The embodiments are not limited to this direction, and can direction all or a portion of the airflow along the rear wall of the appliance in one or more directions (e.g., one or more of vertically, horizontally, at an upward angle, at a downward angle, etc.).

Figure 4:
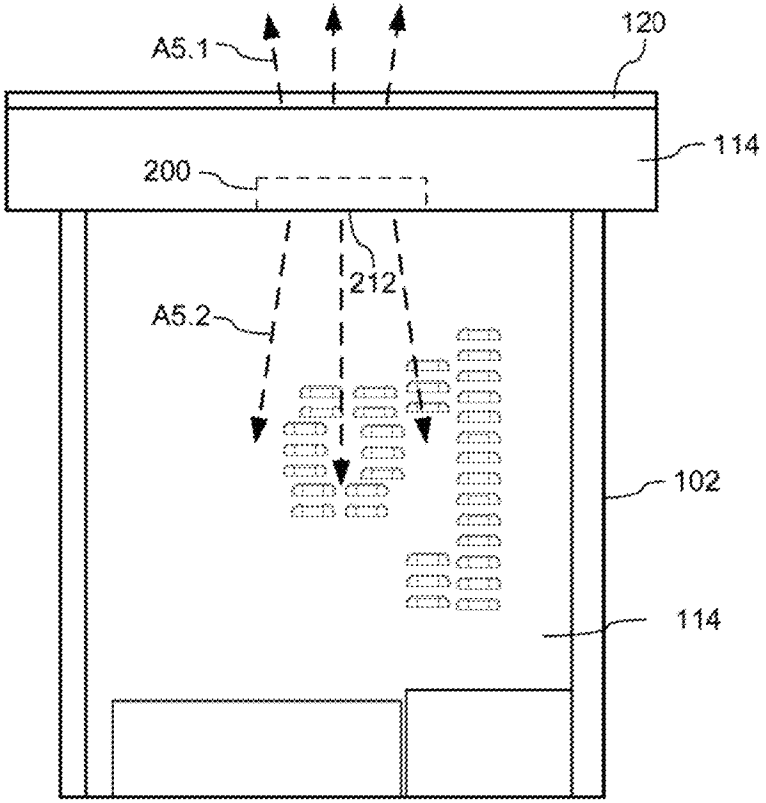
FIG. 4 is a rear view of a home cooking appliance according to an exemplary embodiment of the invention.

With reference again to FIG. 2, and also FIG. 4, the air channel 200 can be formed by an opening in the rear wall 114 of the appliance 100 that exhausts a portion A5.2 of the air from the cooling air system into the space behind the appliance 100. The air channel is not limited to any particular shape, size, or arrangement. The outlet of the air channel 200 can be configured to direct the air A5.2 downward (e.g., vertically or at an angle) from the outlet along an exterior surface of the rear wall 114 of the housing 100. The embodiments are not limited to this direction, and can direction all or a portion of the airflow along the rear wall of the appliance in one or more directions (e.g., one or more of vertically, horizontally, at an upward angle, at a downward angle, etc.). For example, the outlet of the air channel 200 can include a deflector, flange, or the like that directs or deflects the air A5.2 from the outlet along the exterior surface of the rear wall 114 of the housing 102. In another example, the outlet of the air channel 200 can include a deflector, flange, or the like that directs or deflects the air from the outlet vertically along an exterior surface of the rear wall 114 of the housing 102. In yet another example, the outlet of the air channel 200 can include a deflector, flange, or the like that directs or deflects the air from the outlet at an angle other than a vertical direction.

Figure 5:
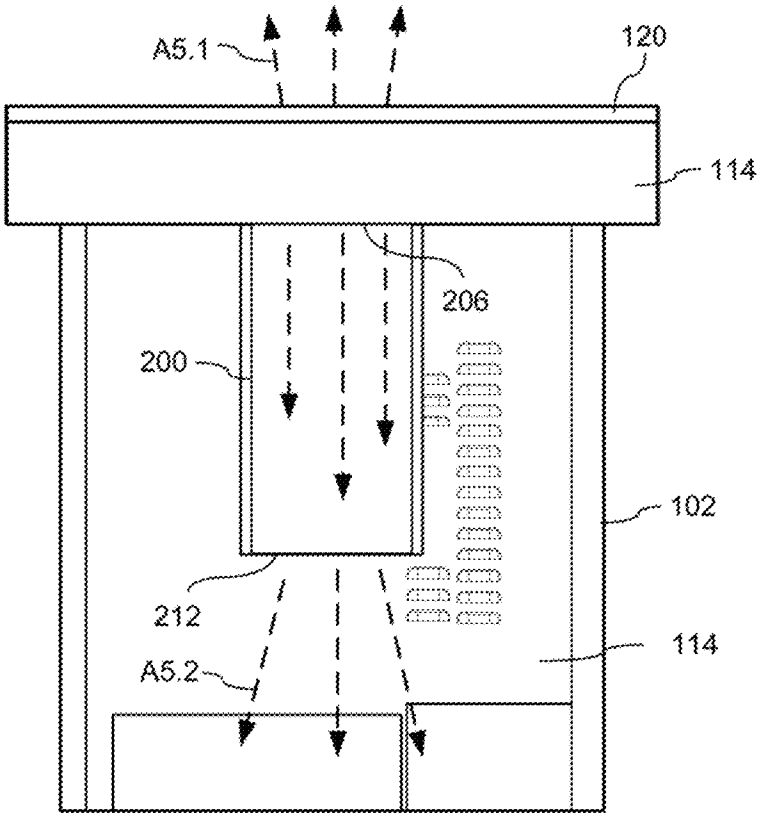
FIG. 5 is a rear view of a home cooking appliance according to another exemplary embodiment of the invention.
Figure 6:
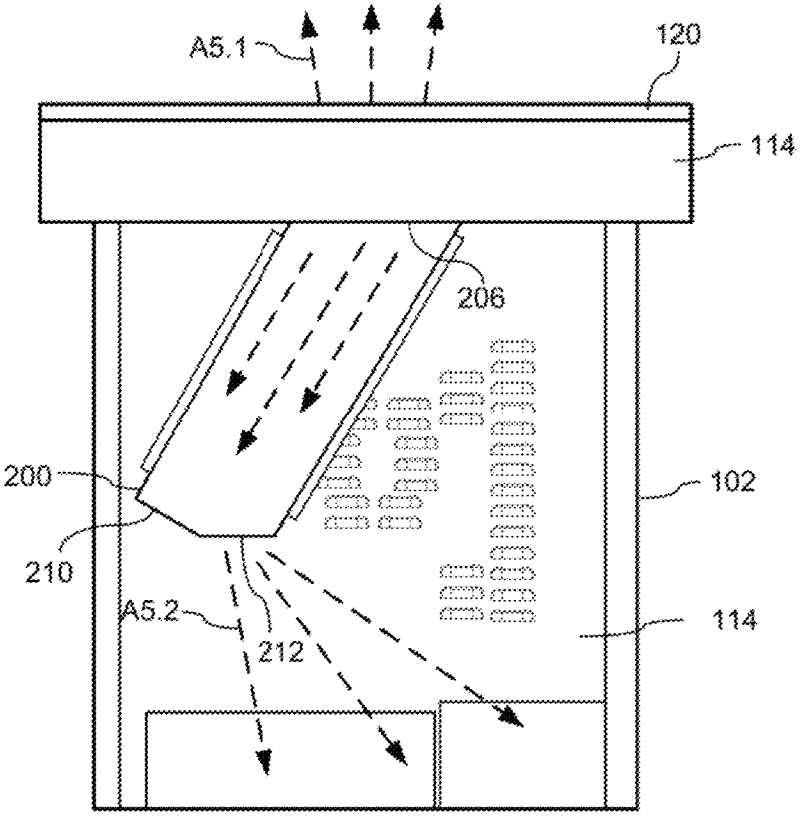
FIG. 6 is a rear view of a home cooking appliance according to another exemplary embodiment of the invention.

With reference again to FIG. 3, and also FIGS. 5 and 6, the air channel 200 can be on an exterior surface of the rear wall 114 of the housing 102. The air channel 200 can be coupled to the rear wall 114 or integrally formed with the rear wall 114. In other embodiments (not shown), the air channel 200 can be disposed inside the housing 102 with respect to the rear wall 114 with the outlet of the air channel 200 exiting the rear wall 114 to the exterior of the housing 102. As shown in FIGS. 3, 5, and 6, all or a portion of the air channel 200 can extend in a downward direction (e.g., vertically or at an angle) along the rear wall 114 of the housing 102.

According to the present invention, one or more of the cross-sectional size, length, direction, and/or angle of the air channel 200, the fan power and fan speed, and other features and functions of the air cooling system can be optimized for the particular cooking appliance 100 to provide passing results on both self-clean testing and all cooktop testing. For example, the air channel 200 can be configured to optimize the placement of the hot air A5.2 behind the appliance 100 to more evenly distribute the heat and minimize or avoid an effect of the hot air on components of the appliance 100. The air channel 200 can be configured to exhaust air in particular locations, or to avoid particular locations, to minimize exposure of certain areas or components to the hot air A5.2, thereby minimizing or avoiding a rise in temperature at these areas or components. The air channel 200 also can be optimized to direct the hot air in a manner that increases temperatures in areas where low temperatures are normally present, and minimize or avoid directing the hot air to areas where higher temperatures are normally present. The air channel 200 can be optimized to direct the hot air A5.2 in a manner that more evenly distributes heat at other areas of the appliance 100, such as, in an area of the rear vent trim 120 as the hot air A5.2 behind the appliance 100 rises upward along the rear wall 114 and past the rear vent trim 120 at the top of the appliance 100, and then combines with the air A5.1, which is exhausted above the appliance.

As shown in FIGS. 2-6, the air channel 200 can be configured, for example, to extend along the rear wall 114 of the appliance 100 to exhaust the air in particular locations and/or in particular directions. The air channel 200 can extend in any direction. For example, the air channel 200 can extend vertically, as shown in FIGS. 3 and 5, horizontally (not shown), or at an angle, as shown in FIG. 6. The air channel 200 also can extend in multiple directions (not shown). The air channel 200 can extend for any distance along the rear wall 114. For example, the air channel 200 can extend only a small portion of the way down the rear wall 114, or not extend at all, as shown in FIGS. 2 and 4. In other embodiments, as shown in FIGS. 3, 5, and 6, the air channel 200 can extend by various other distances down the rear wall 114, depending on the desired placement of the air A5.2 behind the appliance 100.

With reference to FIGS. 2-7D, exemplary embodiments of an air channel 200 will now be described.

As shown in FIGS. 2 and 4, the air channel 200 can include an outlet 212 that is open to an exterior of the rear wall 114 of the appliance 100. The outlet 212 can be configured to direct the hot air A5.2 in a particular direction.

Figure 7A:
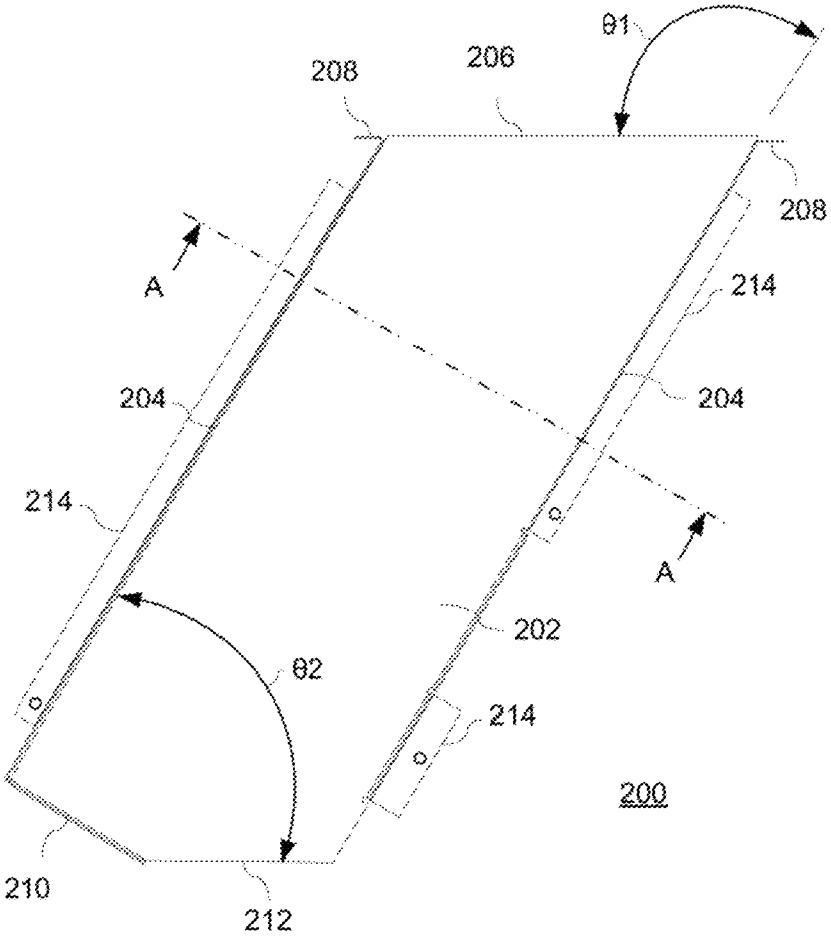
FIG. 7A is a rear view of an air channel for a home cooking appliance according to an exemplary embodiment of the invention.
Figure 7B:
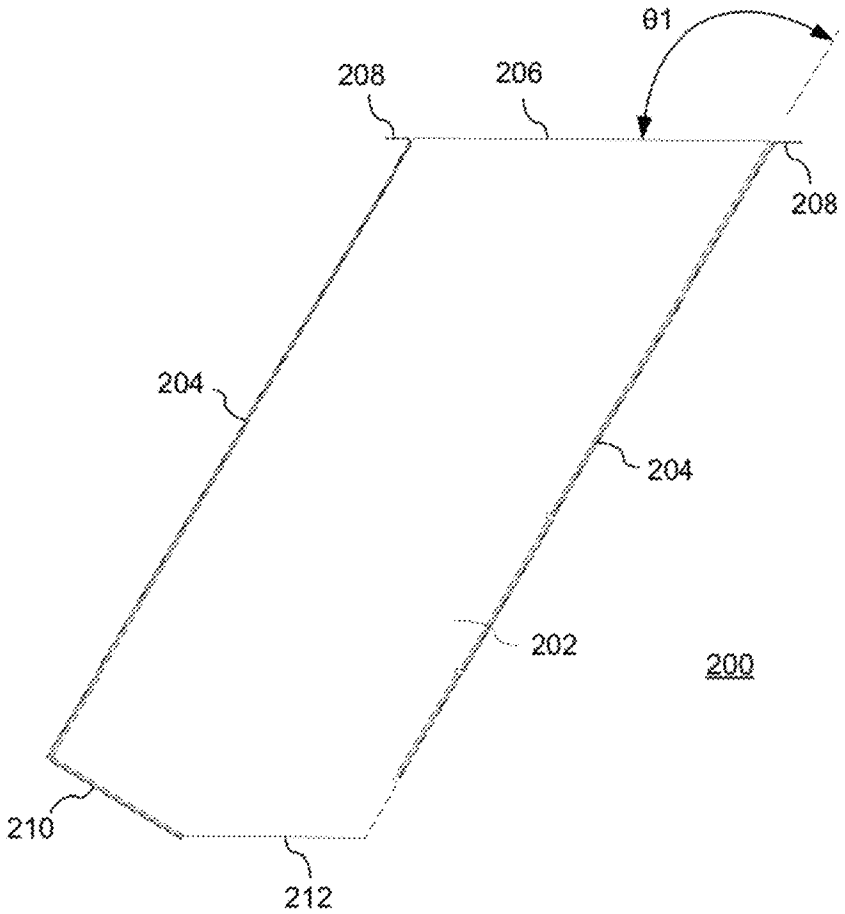
FIG. 7B is a rear, cross-sectional view of the an air channel according to the exemplary embodiment illustrated in FIG. 7A.
Figure 7C:
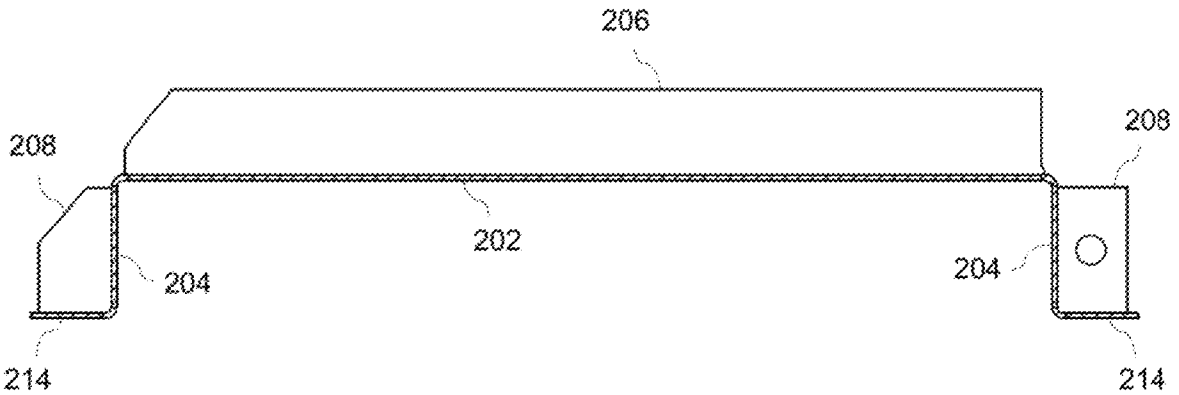
FIG. 7C is a cross-sectional view of the an air channel according to the exemplary embodiment illustrated in FIG. 7A taken along section A-A in FIG. 7A.
Figure 7D:
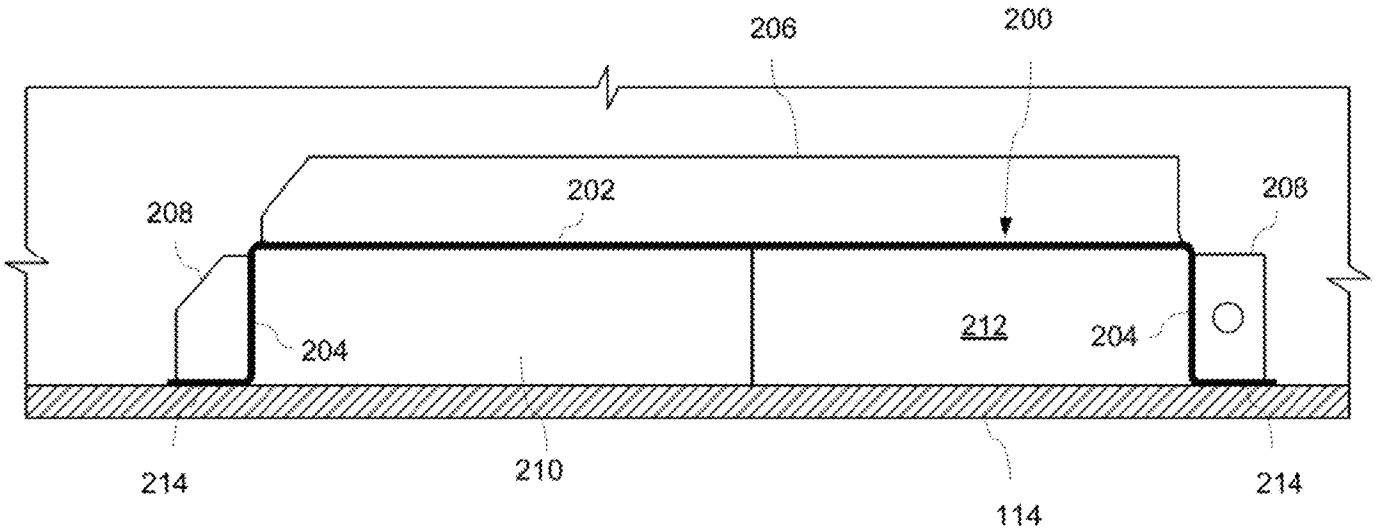
FIG. 7D is a partial bottom view of a home cooking appliance having an air channel according to the exemplary embodiment illustrated in FIGS. 7A-7C.

As shown in FIGS. 3, 5, 6, and 7A, the air channel 200 can include an inlet 206 and an outlet 212, wherein the inlet 206 is configured to be coupled to the cooling air system and the outlet 212 is open to an exterior of the rear wall 114 of the appliance 100. The outlet 212 can be configured to direct the hot air A5.2 in the same direction in which the air channel 200 extends, or in one or more different directions than the direction in which the air channel 200 extends or is angled on the rear wall 114 (e.g., 02 with respect to the direction of the air channel 200 in FIG. 7A). For example, in an exemplary embodiment shown in FIG. 5, the air channel 200 can be configured to extend vertically from a central location in an upper region of the rear wall 114 and then disperse or distribute the air A5.2 in multiple directions from the outlet 212. In another example, as shown in FIGS. 6 and 7A, the air channel 200 can be configured to extend from a central location in an upper region of the rear wall 114 at an angle (e.g., θ1 in FIG. 7A) toward a lower corner of the rear wall 114. The air channel 200 can include a flange, diverter, or wall portion 210 that directs the air A5.2 out of the outlet 212 in a different direction than the direction in which the air channel 200 is angled on the rear wall 114 such that the hot air A5.2 flows along the rear wall 114, for example, toward an opposite side of the rear wall 114. In this way, the air channel 200 can be configured in various arrangements to optimize to more evenly distribute the hot air in the area behind the appliance 100. The exemplary embodiments illustrate the air channel 200 originating at a central location in an upper region of the rear wall 114, which corresponds to a location of the blower 186 and cooling air system in the examples. However, the channel 200 can originate at other locations of the rear wall 114.

In the illustrated examples, the outlet 212 is arranged closer to a bottom of the rear wall 114 of the appliance 100 than the inlet 206. However, other arrangements are contemplated in which the inlet 206 is arranged closer to a bottom of the rear wall 114 of the appliance 100 than the outlet 212, or the inlet 206 and the outlet 212 are horizontally arranged, or face upwards (e.g., vertically or at an angle).

The air channel 200 can be formed by a stand-alone component, such as a sealed duct or channel, extending between the inlet and the outlet. In another embodiment, as shown by the example in FIGS. 7A-7D, the air channel 200 can be formed by one or more walls 202, 204 cooperating with the rear wall 114 of the appliance 100 to form a flow path between the inlet 206 and the outlet 212.

With reference to FIGS. 7A-7D, an exemplary embodiment of an air channel 200 will now be described. The air channel 200 can include a rear wall 202 that is arranged, for example, coplanar with the rear wall 114 of the appliance 100, along with a pair of sidewalls 204 extending from the rear wall 202 of the air channel 200 to the rear wall 114 of the appliance 100, thereby defining an air flow path between the inlet 206 and the outlet 212. The air channel 200 can include one or more connections, such as flanges 208, 214 or other suitable connection means, for coupling the air channel to the cooling air system or the rear wall 114 of the appliance 100. The flanges 208, 214 can be configured to position the air channel 200 at an angle (e.g., θ1 in FIG. 7A) along the rear wall 114. For example, as shown in FIG. 7A, the air channel 200 can be configured to have an angle θ1 with respect to an underside of a part of the rear wall 114 of the appliance. The embodiments are not limited to any particular angle and can include any angle based on the desired placement of the air A5.2 behind the appliance 100.

As shown in the example in FIG. 7A, the outlet 212 can be arranged at an angle θ2 with respect to the sidewalls 204 of the air channel 200. The outlet 212 can be configured to direct the hot air A5.2 in the same direction in which the air channel 200 extends, or in one or more different directions than the direction in which the air channel 200 extends or is angled on the rear wall 114 (e.g., 02 with respect to the direction of the air channel 200 in FIG. 7A).

The embodiments are not limited to any particular angle (e.g., θ1 or 02) and can include any angle based on the desired placement of the air A5.2 behind the appliance 100. Various other arrangements of the air channel 200 are contemplated within the spirit and scope of the invention. The outlet 212 can extend across all or a portion of an outlet end of the air channel 200. In other embodiments, the air channel 200 can include one or more outlets 212 arranged on the surface of the outlet end of the air channel 200, and/or on one or more other surfaces of the air channel 200, such as side walls 204, 206, for dispersing the exhausted air in one or more directions.

FIGS. 8A-10B schematically illustrate test results showing measured surface temperatures at a rear wall of an appliance having based on various exemplary arrangements and optimizations of the air channel 200.

Figure 8B:
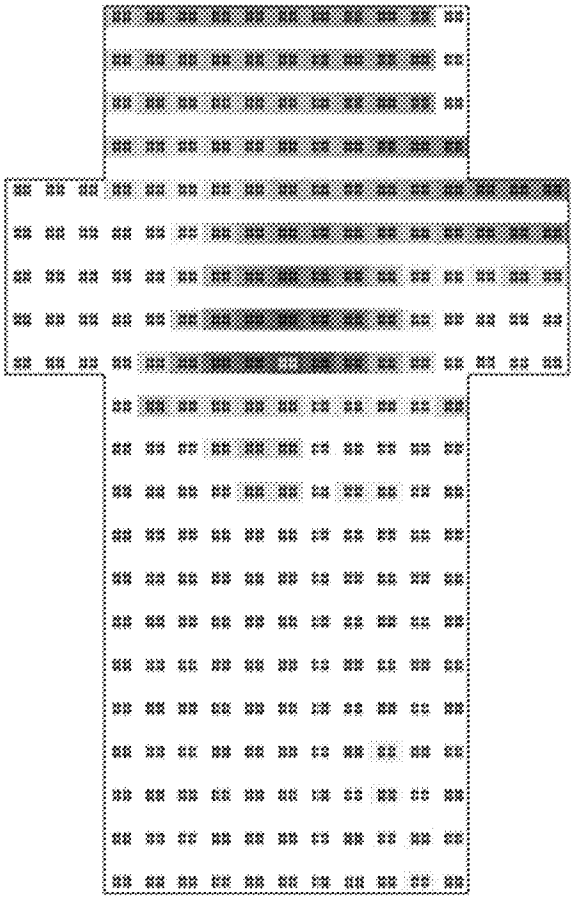
FIG. 8B is a schematic view illustrating test results of measured surface temperatures at a rear wall of an appliance having an air channel according to another exemplary embodiment of the invention.
Figure 8A:
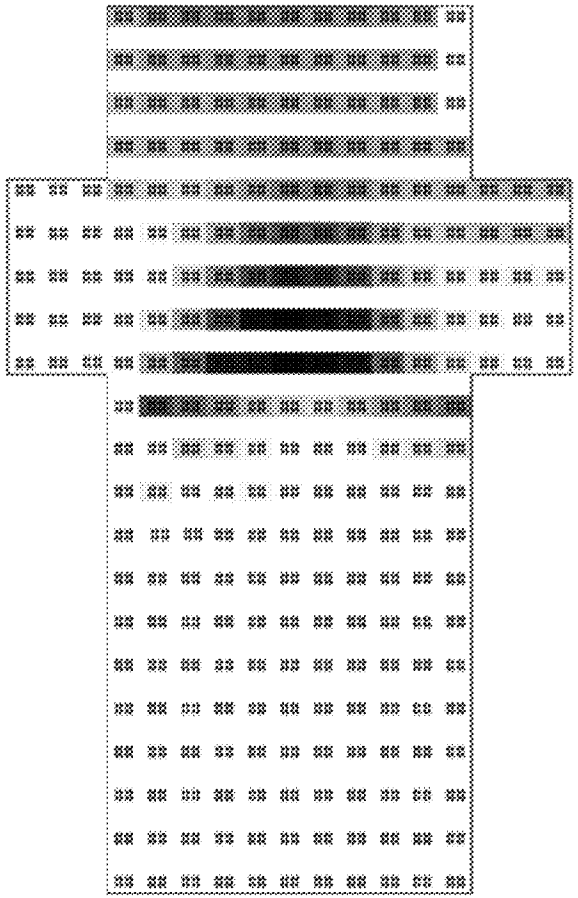
FIG. 8A is a schematic view illustrating test results of measured surface temperatures at a rear wall of an appliance having an air channel according to an exemplary embodiment of the invention.

For example, FIG. 8A schematically illustrates test results showing measured surface temperatures at a rear wall of an appliance having an air channel 200 without balancing the air flow through a rear vent trim 120 and an air channel 200. FIG. 8B schematically illustrates test results showing measured surface temperatures at a rear wall of an appliance having an air channel 200 after balancing the air flow through a rear vent trim 120 and an air channel 200. The cross-sectional inlet to the air channel 200 and the air flow through the air channel 200 and the rear vent trim 120 were optimized during cooktop testing, including during extreme cooktop testing (78,000 BTU at once). As a result, the air channel 200 was able to provide sufficient air flow to direct cooktop heat forward without causing a great amount of heat to be drawn against the rear wall 114. During a self clean test, the air channel 200 also was able to provide sufficient air flow through the appliance 100 to maintain surface temperatures, for example at the oven door, and to protect all components without causing a great amount of heat to be drawn against the rear wall 114.

Figure 9B:
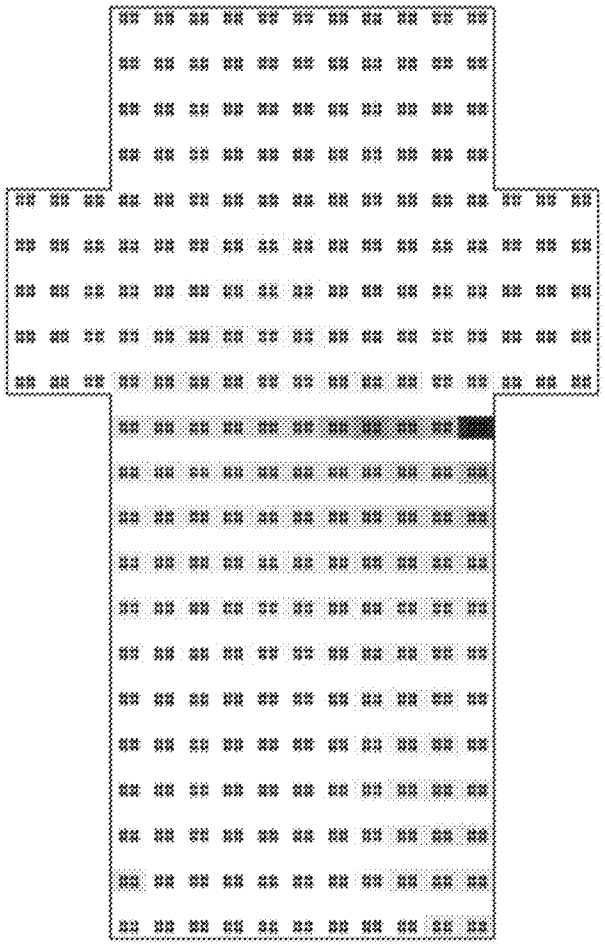
FIG. 9B is a schematic view illustrating test results of measured surface temperatures at a rear wall of an appliance having an air channel according to another exemplary embodiment of the invention.
Figure 9A:
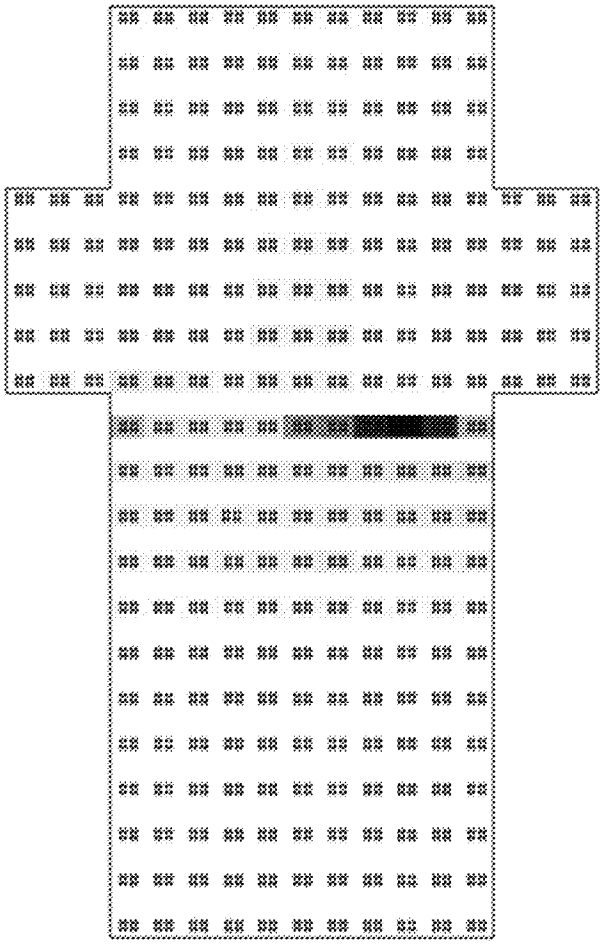
FIG. 9A is a schematic view illustrating test results of measured surface temperatures at a rear wall of an appliance having an air channel according to another exemplary embodiment of the invention.

FIG. 9A schematically illustrates test results showing measured surface temperatures at a rear wall of an appliance having an air channel 200 without an angle. FIG. 9B schematically illustrates test results showing measured surface temperatures at a rear wall of an appliance having an air channel 200 with an angle (e.g., θ1 in FIG. 7A). As explained above, if a temperature of a component, such as a relay board of the appliance, exceeds a threshold temperature, the component may be shut down as a safety measure until the component cools to within acceptable temperatures. The air channel 200 can be arranged at an angle (e.g., θ1 in FIG. 7A) in order to exhaust the air A5.2 in particular locations that limit or avoid temperature increase as such components, or more evenly distribute heat. For example, in some appliances, if a relay board measures any temperature over 90° C., then the gas flow is terminated and the unit begins cooling. Such nuisance tripping can be minimized or prevented by arranging the air channel 200 at an angle (e.g., θ1 in FIG. 7A) to direct the air A5.2 away from areas of such components. The increase in the distance, between the component (e.g., relay board) and air channel outlet 212, allows for more mixing with cooler ambient air before the hot air A5.2 reaches the component, thereby avoiding unsatisfactory increases in temperature at the component. As the test results show, the air channel 200 more evenly distributed the heat, and the air channel 200, by directing the hot air A5.2, allowed the appliance to fully complete self-clean cycles and reduce maximum temperatures at the back wall of the kitchen.

By providing a flange or deflector (e.g., 210 in FIGS. 7A-7D) at the outlet 212 of the air channel 200, another exemplary embodiment was able to more evenly distribute the heat in the area behind the appliance 100. In this example, the flange 210 directed the air flow down and toward the center of the appliance 100 (e.g., at an angle θ2 with respect to the direction of the air channel 200 in FIG. 7A). This embodiment provided advantages of increasing temperatures at locations in which margins existed for temperature increases without exceeding temperature limits, and decreased temperatures at locations in which little or no margins existed for temperature increases without exceeding temperature limits.

FIGS. 10A-10D illustrate thermal imaging showing a comparison between a conventional appliance and an exemplary appliance having the features of the present invention. The thermal imaging illustrates higher temperatures using lighter shades, and illustrates lower temperatures in darker shades. The thermal imaging has been annotated to identify the features of the appliance and the surrounding environment of the kitchen.

Figure 10B:
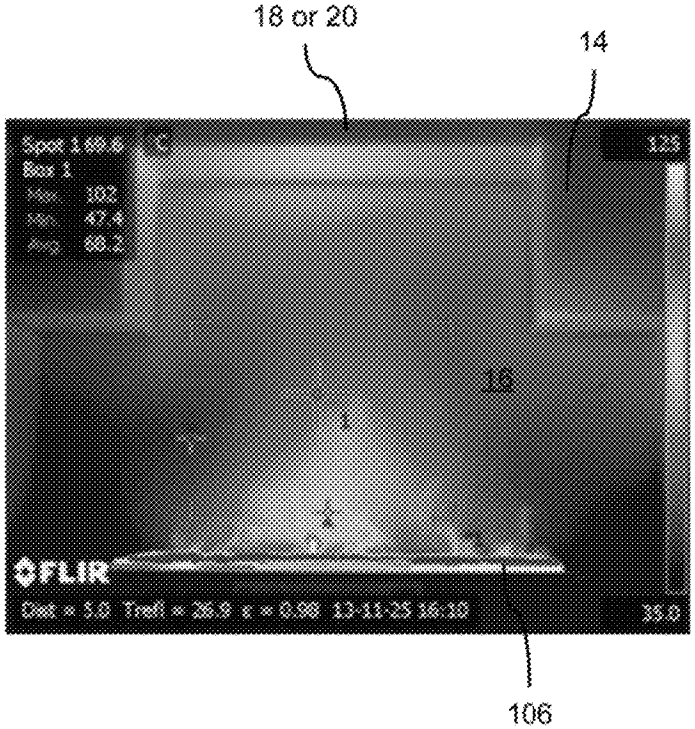
FIG. 10B is a schematic view illustrating test results of measured temperatures on a back wall and adjacent cabinetry of a kitchen over an unoccupied cooking surface of a home cooking appliance according to an exemplary embodiment of the invention.
Figure 10A:
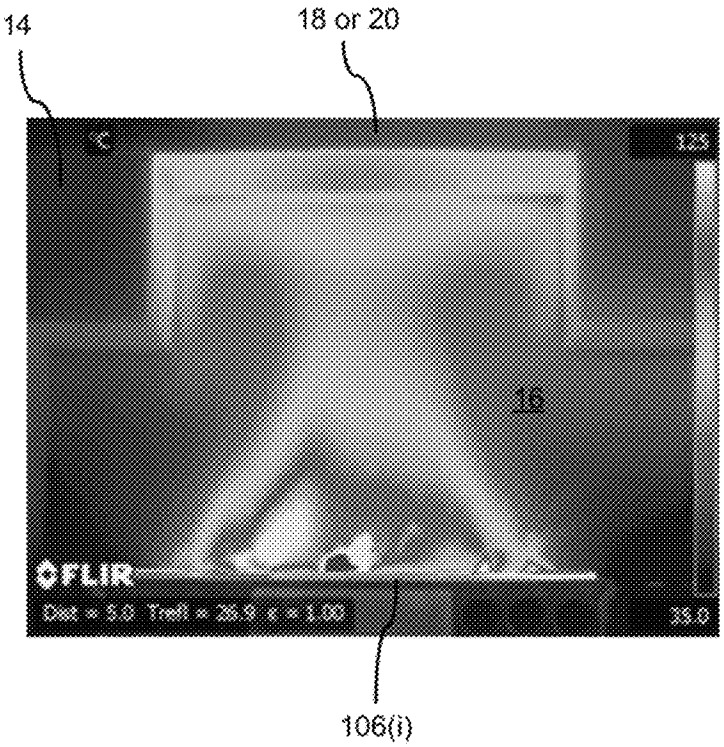
FIG. 10A (CONVENTIONAL ART)
FIG. 10A is a schematic view illustrating test results of measured temperatures on a back wall and adjacent cabinetry of a kitchen over an unoccupied cooking surface of a conventional home cooking appliance.
Figure 10D:
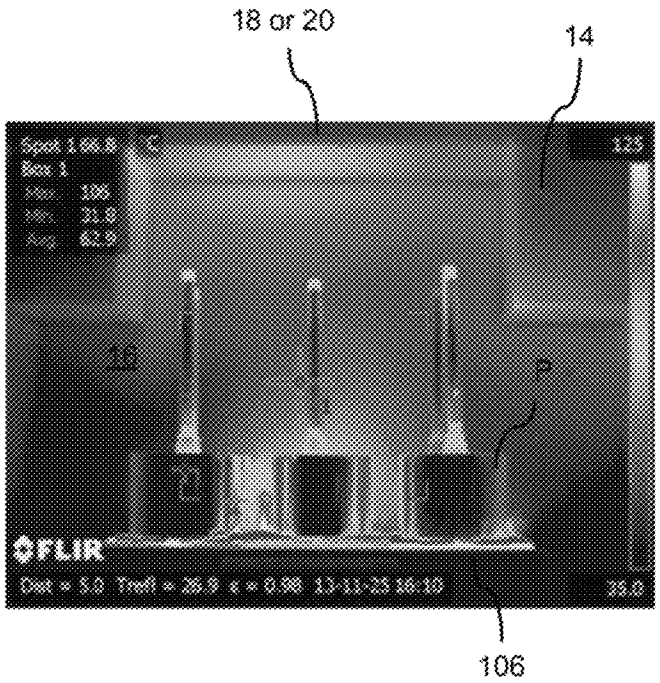
FIG. 10D is a schematic view illustrating test results of measured temperatures on a back wall and adjacent cabinetry of a kitchen over an occupied cooking surface of a home cooking appliance according to an exemplary embodiment of the invention.
Figure 10C:
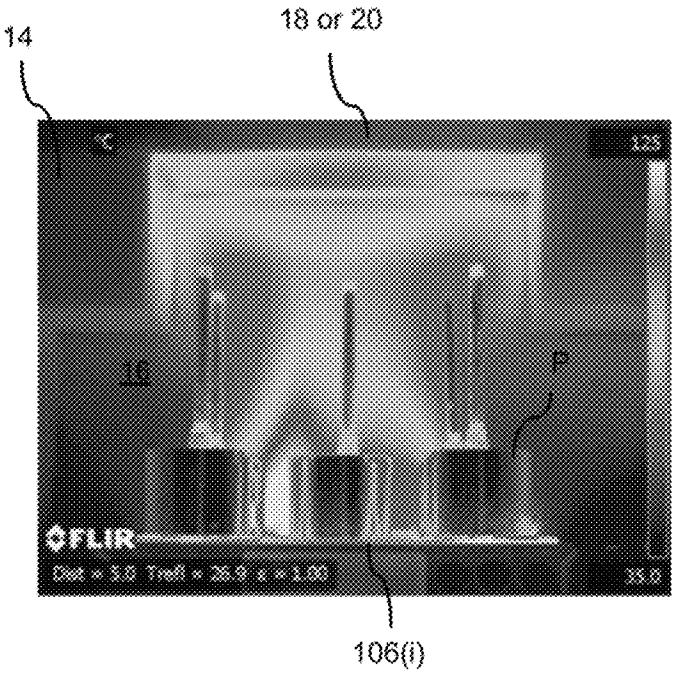
FIG. 10C (CONVENTIONAL ART)
FIG. 10C is a schematic view illustrating test results of measured temperatures on a back wall and adjacent cabinetry of a kitchen over an occupied cooking surface of a conventional home cooking appliance.

Particularly, FIGS. 10A and 10C illustrate thermal imaging of a cooking area above a cooking surface 106(*i*) of a conventional appliance along with the back wall 16 and cabinetry (e.g., 14, 18, 20) of a kitchen. FIG. 10C illustrates special heat-sink pots P with water used for testing purposes. For testing purposes, the conventional appliance was operated with the burners on 80% of full power and the oven was operated for an hour. As shown in FIGS. 10A and 10C, the tests resulted in potentially dangerously high temperatures at the back wall 16 and over-the-range cabinetry (e.g., 14, 18, 20), which may exceed prescribed acceptable limits for industry standards and regulations.

In comparison, FIGS. 10B and 10D illustrate thermal imaging showing a cooking area of an exemplary appliance (e.g., 100 in FIG. 1) having the features of the flue boundary 150, the cooling rough-in box 170, and the rear vent trim 120 according to the present invention, along with the back wall 14 and cabinetry (e.g., 14, 18, 20) of a kitchen. For testing purposes, the exemplary appliance also was operated with the burners on 80% of full power and the oven was operated for an hour. FIG. 10D illustrates special heat-sink pots P with water used for testing purposes of the exemplary appliance. As shown in FIGS. 10B and 10D, the tests resulted in a significant reduction in temperatures at the back wall 14 and over-the-range cabinetry (e.g., 14, 18, 20) compared to the conventional appliance. As a result, the exemplary appliance was able to maintain temperatures below the prescribed limits for industry standards and regulations.

Figure 11B:
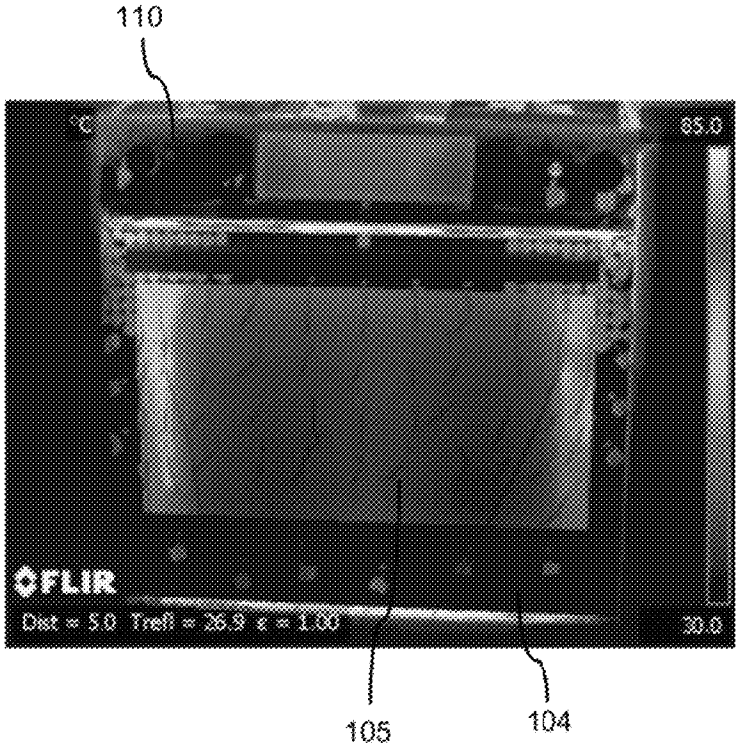
FIG. 11B is a schematic view illustrating test results of measured temperatures on a door of a home cooking appliance according to an exemplary embodiment of the invention.
Figure 11A:
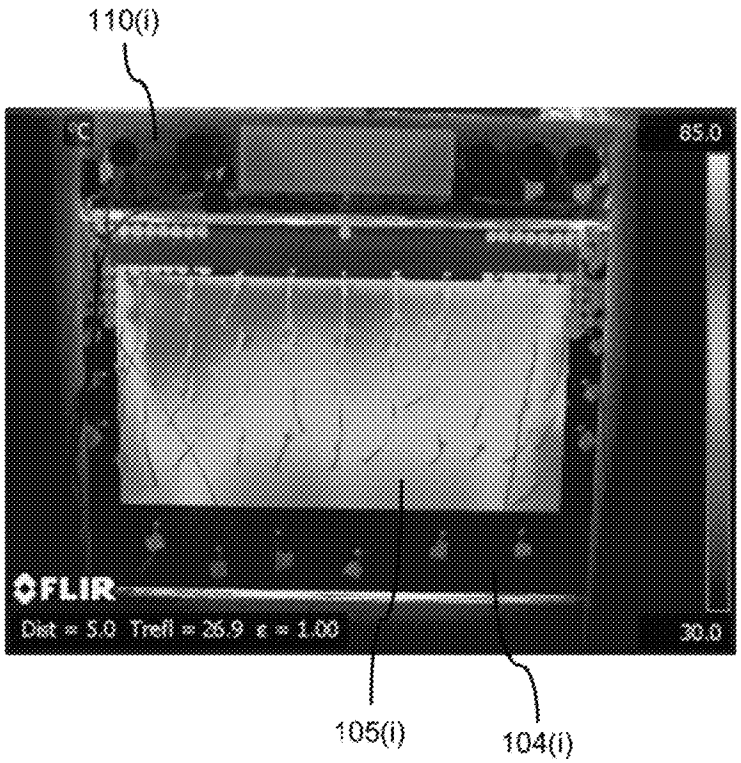
FIG. 11A (CONVENTIONAL ART)
FIG. 11A is a schematic view illustrating test results of measured temperatures on a door of a conventional home cooking appliance.

FIGS. 11A-11B illustrate thermal imaging showing a comparison between a glass oven door 104(*i*) of a conventional appliance and a glass oven door 104 of an exemplary appliance having the features of the present invention. The thermal imaging illustrates higher temperatures using lighter shades, and illustrates lower temperatures in darker shades. The thermal imaging has been annotated to identify the features of the appliance and the surrounding environment of the kitchen.

Particularly, FIG. 11A illustrates thermal imaging of a glass oven door 104(*i*) having door glass 105(*i*) of a conventional appliance where a self-clean cycle of the oven was performed. As shown in FIG. 11A, the tests resulted in potentially dangerously high temperatures at the glass oven door 104(*i*) and door glass 105(*i*), which may exceed prescribed acceptable limits for industry standards and regulations.

In comparison, FIG. 11B illustrates thermal imaging showing a glass oven door 104 having door glass 105 of an exemplary appliance having the features of the flue boundary 150, the cooling rough-in box 170, and the rear vent trim 120 according to the present invention where a self-clean cycle of the oven was performed. As shown in FIG. 11B, the tests resulted in a significant reduction in temperatures at the glass oven door 104 and the door glass 105 compared to the conventional appliance. As a result, the exemplary appliance was able to maintain temperatures below the prescribed limits for industry standards and regulations.

With reference again to FIGS. 1-11B, the flue boundary 150, the cooling rough-in box 170, and/or the rear vent trim 120, either alone or arranged in combination, enable the appliance 100 to minimize wall temperatures and component temperatures, while maintaining passing combustion results, for example, at the burners 108 and cooking compartment 190 (FIG. 7). More particularly, in testing, an exemplary appliance 100 including the flue boundary 150, the cooling rough-in box 170, and/or the rear vent trim 120 maintained good combustion within the cooking compartment while reducing back wall temperatures, for example, by as much 30-60° C. and glass oven door temperatures by as much 30° C., when the features of the flue boundary 150, the cooling rough-in box 170, and the rear vent trim 120 are combined. The exemplary embodiments provide important advantages in that an appliance having the flue boundary 150, the cooling rough-in box 170, and/or the rear vent trim 120 can be configured to be ready to be pushed up against any composition back wall 16 as-is such that a user can install the appliance 100 with minimal or no clearance to a combustible wall 16 and/or under an over-the-range cabinet 18 or component 20, such as an OTR microwave, without any required modifications to the kitchen cabinets, back wall, or countertops. The flue boundary 150, the cooling rough-in box 170, and the rear vent trim 120, both individually and in combination, operate to manage and control the flow of hot air to minimize temperatures at the back wall 16 as well as at the glass oven door 104 and electronic controls of the appliance 100.

Other advantages of the exemplary air channel 200, and particularly in combination with the rear vent trim 120, are that these exemplary arrangements do not blow hot air at a user, allow the burners to function effectively even at lowest settings (without nuisance clicking), allow installation of the appliance with an OTR component (such as an OTR microwave), allow installation of the appliance with a combustible rear wall, and maintain safe door temperatures and electronic component temperatures, even during self clean cycles, particularly when used in combination with other temperature control measures of the exemplary home cooking appliance. By effectively managing and controlling the flow of hot air (e.g., flue gas, cooling air, etc.), the exemplary appliance 100 having the air channel 200 and rear vent trim 120 can assist with balancing and optimizing the air flow in the cooling air system, thereby resulting in improved air flow in and around the appliance, which also results in improved baking results for the oven. Moreover, by effectively managing and controlling the flow of hot air, the exemplary appliance having the air channel 200 and the rear vent trim 120 enables the use of a low-profile rear vent trim having a flush installation with the cooking surface to be used with a high power cooktop (e.g., 60000 BTU/Hr) while complying with industry standards and regulations.

With reference again to FIGS. 1-11B, another exemplary embodiment is directed to a home cooking appliance (e.g., 100) comprising a housing (e.g., 102), a cooking compartment (e.g., 190) in the housing (e.g., 102) and accessible through a door (e.g., 104) in a front of the housing (e.g., 102); a cooling air system (e.g., 180 and flow paths of A1, A2, A3, A4, A5.1, A5.2); a cooling air fan (e.g., 186) that moves air (A1, A2, A3, A4, A5.1, A5.2) through the cooling air system; and an air channel (e.g., 200) in fluid communication with the cooling air system, the air channel (e.g., 200) having an outlet (e.g., 212), for example on a rear wall 114 of the housing (e.g., 102), wherein the air channel (e.g., 200) exhausts a portion (e.g., A5.2) of the air from the cooling air system along the rear wall (e.g., 114) of the housing (e.g., 102).

With reference again to FIGS. 1-11B, another exemplary embodiment is directed to a home cooking appliance (e.g., 100) comprising a housing (e.g., 102), a cooking compartment (e.g., 190) in the housing (e.g., 102) and accessible through a door (e.g., 104) in a front of the housing (e.g., 102); a cooling air system (e.g., 180 and flow paths of A1, A2, A3, A4, A5.1, A5.2); a cooling air fan (e.g., 186) that moves air (A1, A2, A3, A4, A5.1, A5.2) through the cooling air system; and a first exhaust outlet (e.g., 120) in fluid communication with the cooling air system and exhausting a first portion (e.g., A5.1) of the air from the cooling air system; and an air channel (e.g., 200) in fluid communication with the cooling air system, the air channel (e.g., 200) having a second exhaust outlet (e.g., 212), for example on a rear wall 114 of the housing (e.g., 102), wherein the second exhaust outlet (e.g., 212) of the air channel (e.g., 200) exhausts a second portion (e.g., A5.2) of the air from the cooling air system into a first exterior area at the rear wall (e.g., 114) of the housing (e.g., 102). The first exhaust outlet (e.g., 120) can be on the top of the housing (e.g., 102) and can exhaust the first portion (e.g., A5.1) of the air from the cooling air system into a second area above the cooking surface (e.g., 106).

With reference again to FIGS. 1-11B, another exemplary embodiment is directed to a home cooking appliance (e.g., 100) comprising a housing (e.g., 102), a cooking compartment (e.g., 190) in the housing (e.g., 102) and accessible through a door (e.g., 104) in a front of the housing (e.g., 102); a cooling air system (e.g., 180 and flow paths of A1, A2, A3, A4, A5.1, A5.2); a cooling air fan (e.g., 186) that moves air (A1, A2, A3, A4, A5.1, A5.2) through the cooling air system; and first means (e.g., 200) for exhausting a first portion (e.g., A5.2) of the air from the cooling air system along a rear wall (e.g., 114) of the housing (e.g., 102). In another exemplary embodiment, the home cooking appliance (e.g., 100) comprises second means (e.g., 120) for exhausting a second portion (e.g., A5.1) of the air from the cooling air system from the top of the housing (e.g., 102), such as above and/or below a cooking surface (e.g., 106) of the housing (e.g., 102).

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A home cooking appliance comprising:

a housing;

a cooking compartment in the housing and accessible through a door in the housing;

a cooling air system having a cooling fan that conveys ambient kitchen air into and through the housing between the cooking compartment and the housing to cool components of the home cooking appliance, the cooling air system configured to divide and separate air from the ambient kitchen air into at least a first portion and a second portion;

an air channel in fluid communication with the cooling air system, the air channel having an inlet that receives the first portion of the air from the cooling air system and an outlet that exhausts the first portion of the air from the cooling air system along an exterior surface of a rear wall of the housing; and a rear vent trim on a top of the housing and in fluid communication with the cooling air system, the rear vent trim including an opening permitting the second portion of the air from the cooling air system to exit from the top of the housing, wherein the cooling air system is configured to divert the first portion of the air into the air channel to be exhausted from the outlet along the exterior surface of the rear wall of the housing to a first exterior area behind the housing, and to divert the second portion of the air to the rear vent trim to be exhausted from the opening of the rear vent trim to a second exterior area above the housing, to thereby increase an amount of the air flowing through the cooling air system while minimizing noise from the cooling fan, and wherein the outlet of the air channel is located at an upper region of the rear wall of the housing.

2. The home cooking appliance of claim 1, wherein the outlet of the air channel directs the first portion of the air from the outlet in a downward vertical direction along the exterior surface of the rear wall of the housing.

3. The home cooking appliance of claim 1, wherein the outlet of the air channel directs the first portion of the air from the outlet in a downward direction extending at an angle other than a vertical direction along the exterior surface of the rear wall of the housing.

4. The home cooking appliance of claim 1, wherein the outlet of the air channel directs the first portion of the air from the outlet at a first angle other than a vertical direction and a horizontal direction.

5. The home cooking appliance of claim 1, wherein the cooling air system comprises:

a cavity in fluid communication with the air channel and the rear vent trim, the cavity dividing the air flowing through the cooling air system into the first portion and the second portion, wherein the cavity includes a first exit that conveys the first portion of the air to the inlet of the air channel and a second exit that conveys the second portion of the air to the rear vent trim.

6. The home cooking appliance of claim 5, wherein the cooling fan conveys the air flowing through the cooling air system into the cavity, thereby pressurizing the cavity, and wherein the pressurized cavity diverts the first portion of the air from the pressurized cavity to the inlet of the air channel and through the air channel to the outlet of the air channel and the second portion of the air from the pressurized cavity to the opening of the rear vent trim on the top of the housing.

7. The home cooking appliance of claim 1, wherein the cooling air system includes an air diverting cavity disposed downstream of the cooling fan, the air diverting cavity configured to divide and separate the air from the ambient kitchen air conveyed by the cooling fan into the first portion of the air and the second portion of the air, wherein the inlet of the air channel receives the first portion of the air from the air diverting cavity and the rear vent trim receives the second portion of the air from the air diverting cavity, and wherein the air diverting cavity of the cooling air system is configured to divert the first portion of the air into the air channel to be exhausted from the outlet along the exterior surface of the rear wall of the housing and to divert the second portion of the air to the rear vent trim to be exhausted from the opening of the rear vent trim.

8. The home cooking appliance of claim 7, wherein the cooling fan conveys the air flowing through the cooling air system into the air diverting cavity and pressurizes the air diverting cavity.

9. The home cooking appliance of claim 1, wherein the air channel operates as a decompression chamber to depressurize the first portion of the air from the cooling air system.

10. The home cooking appliance of claim 8, wherein the air channel operates as a decompression chamber to depressurize the first portion of the air received from the air diverting cavity before exhausting the first portion of the air from the outlet along the exterior surface of the rear wall of the housing.

11. The home cooking appliance of claim 1, wherein the outlet of the air channel includes a deflector that directs the first portion of the air from the outlet in a direction along the exterior surface of the rear wall of the housing.

12. A home cooking appliance comprising:

a housing;

a cooking compartment in the housing and accessible through a door in the housing;

a cooling air system having a cooling fan that conveys ambient kitchen air into and through the housing between the cooking compartment and the housing to cool components of the home cooking appliance, the cooling air system including an air diverting cavity disposed downstream of the cooling fan, the air diverting cavity configured to divide and separate air from the ambient kitchen air conveyed by the cooling fan into at least a first portion of the air and a second portion of the air;

an air channel in fluid communication with the cooling air system, the air channel having an inlet that receives the first portion of the air from the air diverting cavity of the cooling air system and an outlet that exhausts the first portion of the air from the cooling air system along an exterior surface of a rear wall of the housing, wherein the outlet of the air channel is located at an upper region of the rear wall of the housing; and a rear vent trim on a top of the housing and in fluid communication with the cooling air system, the rear vent trim receiving the second portion of the air from the air diverting cavity and including an opening permitting the second portion of the air to exit from the top of the housing, wherein the air diverting cavity of the cooling air system is configured to divert the first portion of the air into the air channel to be exhausted from the outlet along the exterior surface of the rear wall of the housing to a first exterior area behind the housing, and to divert the second portion of the air to the rear vent trim to be exhausted from the opening of the rear vent trim to a second exterior area above the housing, to thereby increase an amount of the air flowing through the cooling air system while minimizing noise from the cooling fan, and wherein the air diverting cavity includes a first exit that conveys the first portion of the air to the inlet of the air channel and a second exit that conveys the second portion of the air to the rear vent trim.

13. The home cooking appliance of claim 12, wherein the air channel operates as a decompression chamber to depressurize the first portion of the air received from the air diverting cavity before exhausting the first portion of the air from the outlet at the upper region of the rear wall of the housing and along the exterior surface of the rear wall of the housing.

14. The home cooking appliance of claim 13, wherein the outlet of the air channel directs the first portion of the air from the outlet in a downward vertical direction along the exterior surface of the rear wall of the housing.

* * * * *